US005979647A

United States Patent [19]

Han

[11] Patent Number: 5,979,647

[45] Date of Patent: Nov. 9, 1999

[54] LID FOR CONTAINER

[76] Inventor: Ki Su Han, 2249 Lerona Ave., Rowland Heights, Calif. 91748

[21] Appl. No.: 09/096,058

[22] Filed: Jun. 11, 1998

Related U.S. Application Data

[63] Continuation-in-part of application No. 09/001,153, Dec. 30, 1997.

[51] Int. Cl.[6] ..... B65D 25/08

[52] U.S. Cl. ..... 206/222; 206/568; 220/521

[58] Field of Search ..... 206/219, 222, 206/217, 568; 220/521; 215/227

[56] References Cited

U.S. PATENT DOCUMENTS

| | | |
|---|---|---|
| 3,779,372 | 12/1973 | de Lioret . |
| 3,796,813 | 3/1974 | Kurland . |
| 4,387,809 | 6/1983 | Botzler . |
| 4,631,715 | 12/1986 | Hoover . |
| 4,785,931 | 11/1988 | Weir et sl. . |
| 5,035,320 | 7/1991 | Plone . |
| 5,052,553 | 10/1991 | De Sanctis . |
| 5,125,534 | 6/1992 | Rose et al. . |
| 5,431,276 | 7/1995 | Lialin . |
| 5,529,179 | 6/1996 | Hanson . |
| 5,711,420 | 1/1998 | Spring . |

*Primary Examiner*—Paul T. Sewell
*Assistant Examiner*—Nhan T. Lam

[57] ABSTRACT

A disposable lid is used with a container has pre-stored additives such as sugar or cream. The base member has at least one compartment region which has a sealed outlet and a cover sealing the compartment region to prevent the additive from exiting the compartment region. When the cover is actuated, the outlet breaks open and allows the additive in the compartment region to flow into the container. The outlet in the base member projects from the base member and preferably has troughs formed in the outlet. The outlet is arranged under the cover, and when the cover is depressed the outlet opens at the troughs to allow the content to exit out of the compartment region. The cover is preferably made of a flexible material to permit the outlet to be depressed by applying pressure on the cover. The compartment region of the base member is formed by raised walls surrounding the compartment region, the cover being affixed to top of the raised wall to create an air tight seal.

19 Claims, 5 Drawing Sheets

LID FOR CONTAINER

This is a continuation-in-part of application Ser. No. 09/001,153 filed on Dec. 30, 1997.

BACKGROUND OF THE INVENTION

1. Field of the Invention

This invention relates to Ea disposable lid for beverage container, and more particularly, to a disposable lid having a plurality of compartments having outlets for storing and releasing contents therein through the outlets.

2. Description of Related Art

Beverage container lids are well-known to prevent the spillage of the contents of the container. Plastic disposable lids having openings for inserting plastic straw are commonly found in fast food restaurants. Similarly, disposable lids for hot beverage, such as coffee and tea, are also commonly used.

Conventional disposable lids have removable flaps and/or straw openings to access the content. When drinking hot beverage, the flaps are either removed or folded backwards to create a drinking hole. However, in many conventional lids, the opening is not sufficiently large to pour in sugar and cream. In stead, the entire lid must be first removed to add desired amount of sugar and cream into the content. The use of such conventional lids may not be problematic when a consumer is not driving. However, many drivers purchase their food and drinks through drive-in windows of restaurants and eat and drink while driving. Driving while eating and drinking already creates danger to the driver as well as others driving near by. To compound the problem, many drivers try to add sugar and cream to their drinks while driving. The design of conventional plastic lid provides no other alternative but to completely remove the plastic lid from a container containing hot beverage and adding cream and sugar therein. Such construction of plastic lids is cumbersome and sometimes creates a dangerous driving condition.

Another problem with convention disposable lids is that once sugar and cream are added into the container, the packages for sugar and cream must be separately discarded creating more trash.

SUMMARY OF THE DISCLOSURE

It is an objective of the present invention to provide a disposable lid which overcomes the aforementioned shortcomings and disadvantages associated with conventional designs. Specifically, the present invention allows the addition of additives, such as cream and sugar or other edible substance, into the container without physically opening the lid.

It is another object of the present invention to provide a disposable lid which contains sugar and cream therein so that the entire container may be discarded after the content has been consumed.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a lid for use with a container has pre-stored contents and includes a base member sized to fit over the container, the base member having at least one compartment region which has a sealed outlet, and a cover sealing the compartment region to prevent the content from exiting the compartment region. When the cover is actuated, the outlet breaks open and allows the content in the compartment region to flow into the container.

The outlet in the base member preferably projects from the base member and has troughs formed around the outlet to allow easy tear. The outlet is arranged below the cover, and when the cover is depressed the outlet opens at the troughs to allow the content to flow out of the compartment region. The cover is preferably made of a flexible material to permit the outlet to be depressed by applying pressure on the cover. The cover further comprises a tab protruding from the cover and forming an integral part of the cover. The tab is substantially aligned with the outlet to permit the outlet to be depressed by applying pressure on the tab.

According to one aspect of the present invention, the compartment region of the base member is formed by raised walls surrounding the compartment region, the cover being affixed to the top of the raised wall to create an air tight seal.

In an alternative embodiment, the cover has lowered walls surrounding the compartment regions of the base member, the base member being affixed to the bottom of the lowered walls to create an air or fluid tight seal. The cover further includes an actuating region having a downward projection. An outlet of the base member is an aperture substantially aligned with the actuating region in the cover and sealed with a sealing layer. The sealing layer breaks open when the actuating region is depressed. Accordingly, the sealing layer is made of a thin plastic which is easily rupturable.

According to another aspect of the present invention, the cover further comprises an actuating region and the outlet projects from the base member and has troughs formed in the outlet. The outlet is substantially aligned with the actuating region and opens at the troughs to allow the content to flow out of the compartment region when the actuating region is depressed. The actuating region has a tab protruding from the cover and forming an integral part of the cover. The tab is substantially aligned with the outlet to permit the outlet to be depressed by applying pressure on the tab. In this configuration, the cover is made with a rigid material, and preferably made with the same material as the base member.

Moreover, the base member has a spout actuator which creates an aperture, when depressed, to drink the content from the container. To accommodate the spout actuator when the cover is attached to the base member, the cover has a spout region which substantially surrounds the spout actuator.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
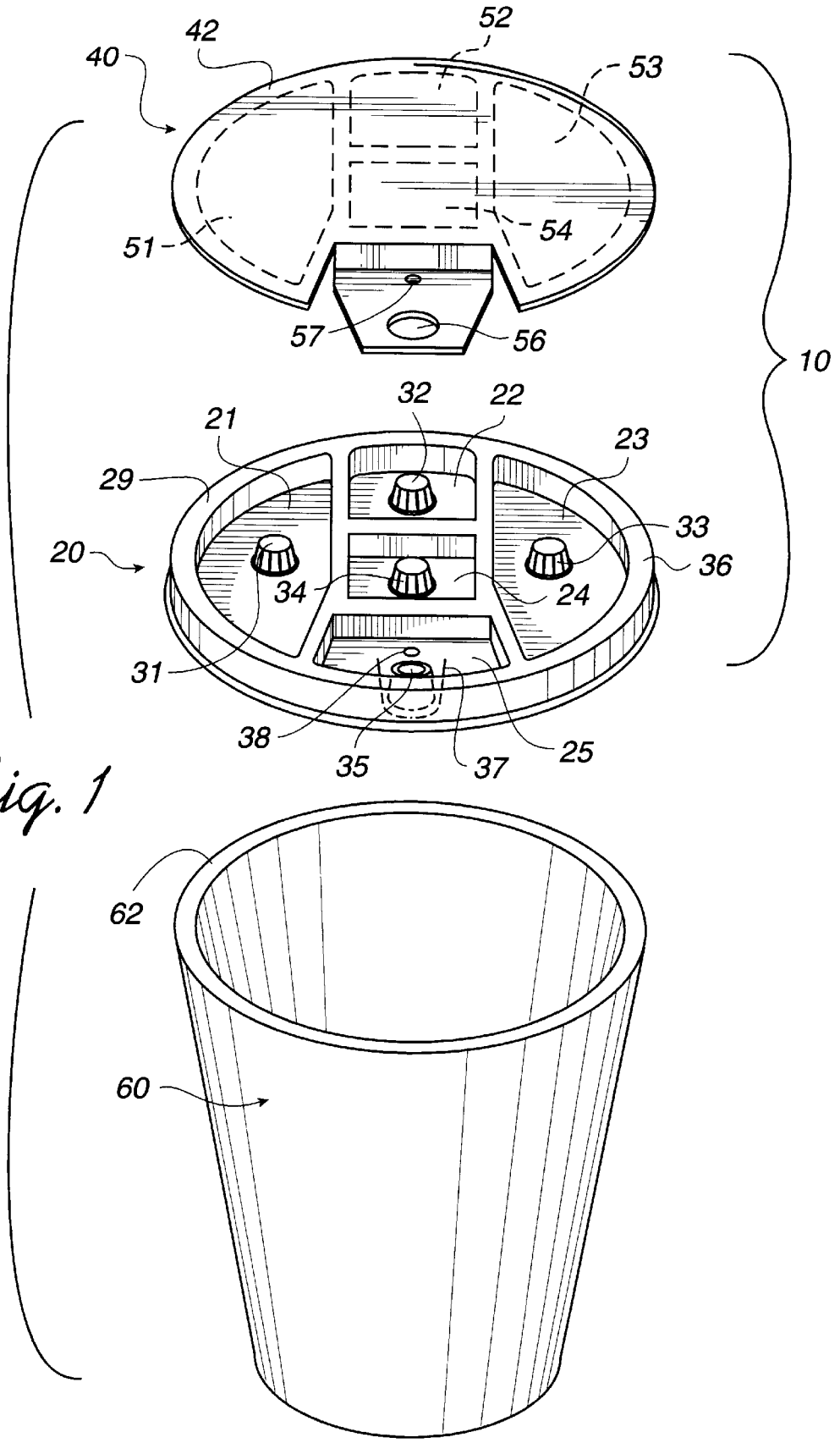
FIG. 1 illustrates a disposable lid according to a first embodiment of the present invention.

FIG. 1 illustrates a perspective view of a disposable lid 10 for a beverage container 60 according to a first embodiment of the present invention. The disposable lid 10 includes a disc shaped base member 20 and a similarly shaped cover top 40. The base member 20 is preferably made with plastic and is designed to be used with a conventional disposable beverage container 60. The top cover 40 affixed to the top of the base member 20 are placed on the opening defined by the container 60 fluid tightly sealing the container 60.

The base member 20 is preferably used for capping the container 60, such as a Styrofoam cup, containing hot liquid. The base member 10 has compartments 21–24 for storing additives in powder or liquid form, such as cream or sugar. For example, the compartments 21 and 22 may contain cream and the compartments 23 and 24 may contain sugar. The base member 10 also has a spout region 25 separated from other compartments 21–24 with walls. Each one of the compartments 21–24 are separated by raised walls made during, for example, an injection molding process. The size of each compartment can be varied depending on the amount of additives to be stored therein. Alternatively, instead of having four compartments 21–24 as shown in FIG. 1, the base member 10 may have fewer or more compartments.

Figure 4:
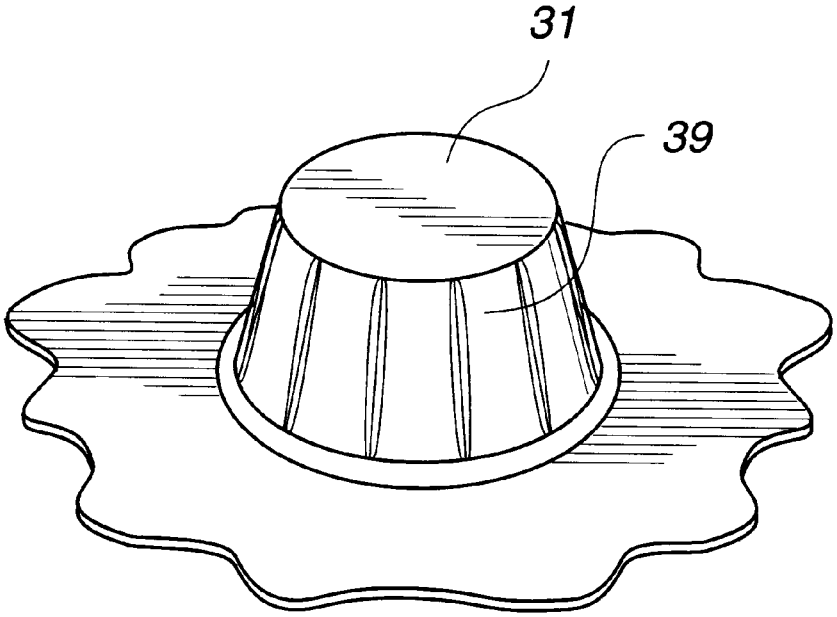
FIG. 4 illustrates an outlet projecting from the base member.

The base member 20 has protruding outlets 31–34 each one having a half-cone shape. The enlarged illustration of the protruding outlet 31 is shown in FIG. 4. The protruding outlets 31–34 are made of the same material with the rest of the base member 10, and preferably are integrally manufactured with the base member 20. The protruding outlets 31–34 have substantially vertical troughs 39 formed around the inner surface of the base member 20 which can be easily torn when depressed. The protruding outlets 31–34 preferably have identical heights and are no higher than the height of the rim 29. The troughs 39 may be formed by perforation or half-depth incisions, such as the ones used for forming the drinking opening, during thermo-formation of the base member 20.

The base member 20 includes a rim 29 constructed to engage an opening defined by a rim 62 of the beverage container 60 to hold the base member 20 firmly on the container 60. The rim 29 surrounds a disk-like body of the base member 20 which covers the container opening when the base member 20 is placed on the container 60.

In the spout region 25 of the base member 10, there is a raised spout actuator 35 and a vent hole 38. To drink out of the cup, the raised spout actuator 35 is depressed with a lip which creates an opening defined by a surrounding shallow trough 37. More specifically, the lid opening is defined by the shallow trough 37 thermoformed during manufacturing. When the raised spout actuator 35 is depressed, the trough 37 is tore opened in a shape defined by the trough 37 thus forming a lid opening.

After the additives, such as cream and sugar, are individually placed in the compartments 21–24, the top surface portion of the base member 20 is covered with the top cover 40. The top cover 40 is preferably made with a flexible and resilient material, such as vinyl, and is attached to the base member 20 so that each compartment 21–24 is preferably air or fluid tightly sealed. Preferably, the top cover 40 and base member 20 may be either pressure or thermal sealed together. More specifically, the sealable region 42 of the top cover 40 is fluid tightly affixed to the top of the raised walls defining the compartments 21–24. As a result, the cover compartment regions 51–54 are placed substantially above the compartments 21–24 of the base member 20. Because the top cover 40 is made with a flexible material, the top cover region immediately above each protruding outlet 31–34 can be depressed without disturbing the integrity of the seal created by the base member 20 and the top cover 40. The depression of the protruding outlets 31–34 in the base member 10 through the top cover 40 causes the protruding outlets 31–34 to be vertically contracted, which in turn causes the troughs 39 to break and thus allows sugar or cream, either in liquid or powdered form, to flow into the container 60.

As an alternative embodiment, instead of using the top cover 40 which substantially covers the entire base member 20, the top cover may be designed to cover only the compartments formed in the base member 20. In that regard, individual cover pieces may be used to cover different compartments in the base member 20.

At the spout region 25, the top cover 40 is folded down to flushly affixed to the top surface of the spout region 25. This construction allows the content of the container 60 to flow out when the spout actuator 35 is depressed with a lip. Alternatively, the spout region may not be covered at all with the top cover 40. In addition, a vent hole 57 formed in the top cover 40 is aligned with the vent hole 38 of the base member, and thus, they are in fluid communication with each other.

When a user wishes to add cream into the coffee contained in the container 60, the protruding outlet 31, for example, is depressed, which in turn tears the protruding outlet 31 due to vertical troughs formed thereon. As a result, the cream contained in the compartment 21 flows into the container 60.

Figure 2:
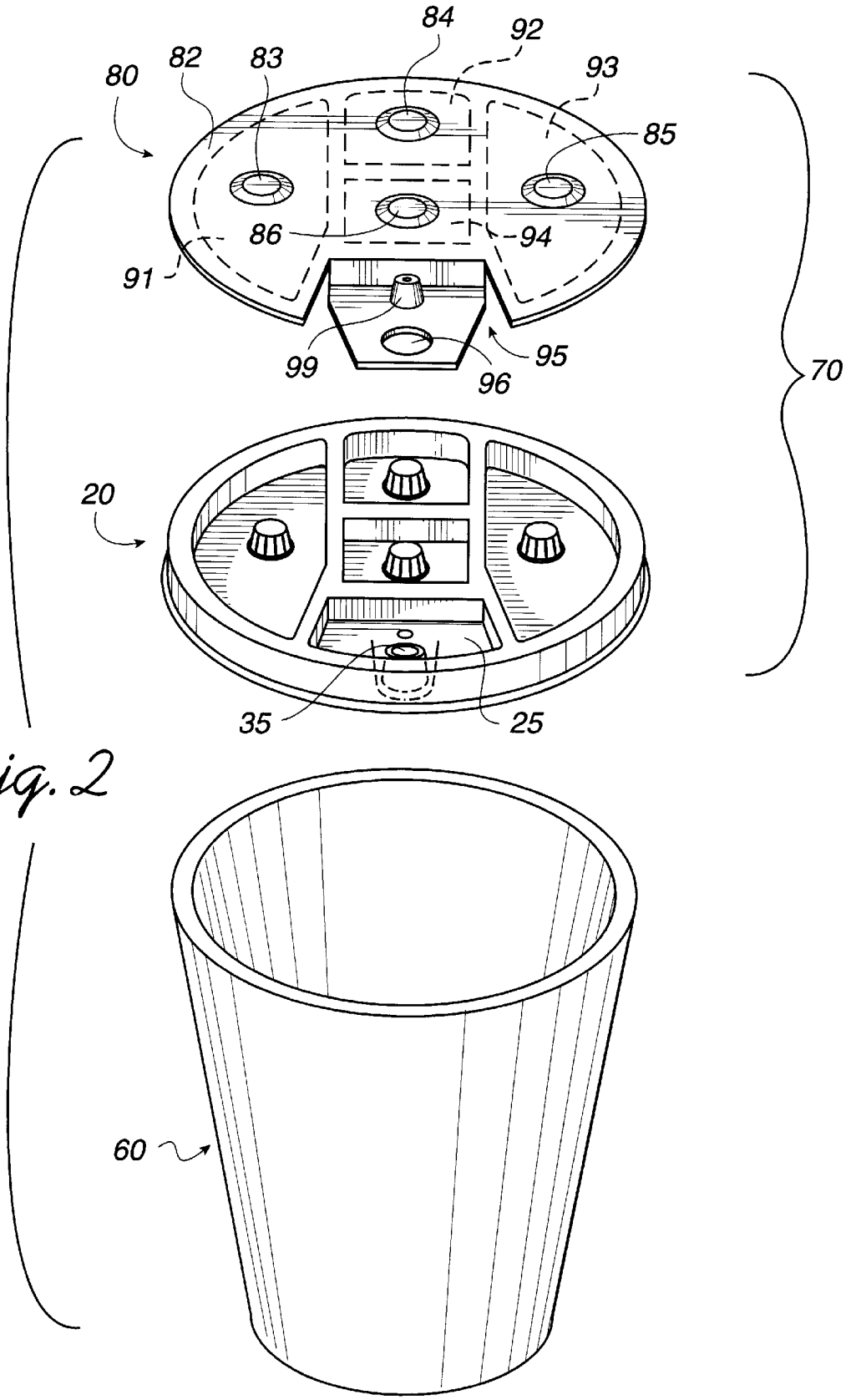
FIG. 2 illustrates the disposable lid according to a second embodiment.

FIG. 2 illustrates the disposable lid 70 according to the second embodiment of the present invention. According to the second embodiment, the disposable lid 70 contains the identical base member 20 but has a different top cover 80. Similar to the disposable lid 10 shown in FIG. 1, the base member 20 of the second embodiment is covered with the top cover 80. The top cover 80 is made with more rigid materials, such as plastic. Preferably, the top cover 80 and base member 20 may be made of the same material and are either pressure or thermal sealed together. The function of the top cover 80 of the second embodiment is identical to the top cover 40 of the first embodiment. However, because the top cover 80 is made with a more rigid material, it is not as flexible as the top cover 40 of the first embodiment. To allow easy depression of the protruding outlets 31–34 in the base member 10, the top cover 80 is equipped with correspondingly aligned depressible tabs 83–86.

The top cover 80 is attached to the base member 20 so that each compartment 21–24 is preferably air or fluid tightly sealed. More specifically, the sealable region 82 of the top cover 80 is affixed to the top of the raised walls defining the compartments 21–24 of the base member 20. As a result, the cover compartment regions 91–94 are placed substantially above the compartments 21–24 of the base member 10. Because the top cover 80 is made with a rigid material, the top cover region immediately above each protruding outlet 31–34 can be depressed with the assistance of the depressible tabs 83–86. The depression of the protruding outlets 31–34 in the base member 10 through the corresponding tabs 83–86 of the top cover 80 causes the protruding outlets 31–34 to be vertically contracted which in turn causes the troughs to break and thus allows sugar or cream, either in liquid or powdered form, to flow into the container 60.

At the spout region 25 of the base member 20, the corresponding spout region 95 of the top cover 80 is constructed to fold down to flushly affixed to the top surface of the spout region 25. The top cover 80 has an opening 96 aligned with the spout actuator 35. This construction allows the content of the container 60 to flow out when the spout actuator 35 is depressed with a lip. When the spout actuator 35 is not depressed, the spout actuator 35 flexes back to the opening 96 formed in the top cover 80, hence preventing the liquid content from flowing out.

Alternatively, the spout region 25 may not be covered at all with the top cover 80. In addition, a vent tube 97 formed in the top cover 80 is aligned with the vent hole 38 of the base member, and thus, they are in fluid communication with each other. The use of the vent tube 97 in lieu of the vent hole prevents fluid contained in the container 60 from squirting out hence burning the lip.

When a user wishes to add cream into the coffee contained in the container 60, the tab 83, for example, is depressed, which in turn tears the corresponding protruding outlet 31 due to vertical troughs made thereon. As a result, the cream contained in the compartment 21 flows into the coffee.

Figure 3:
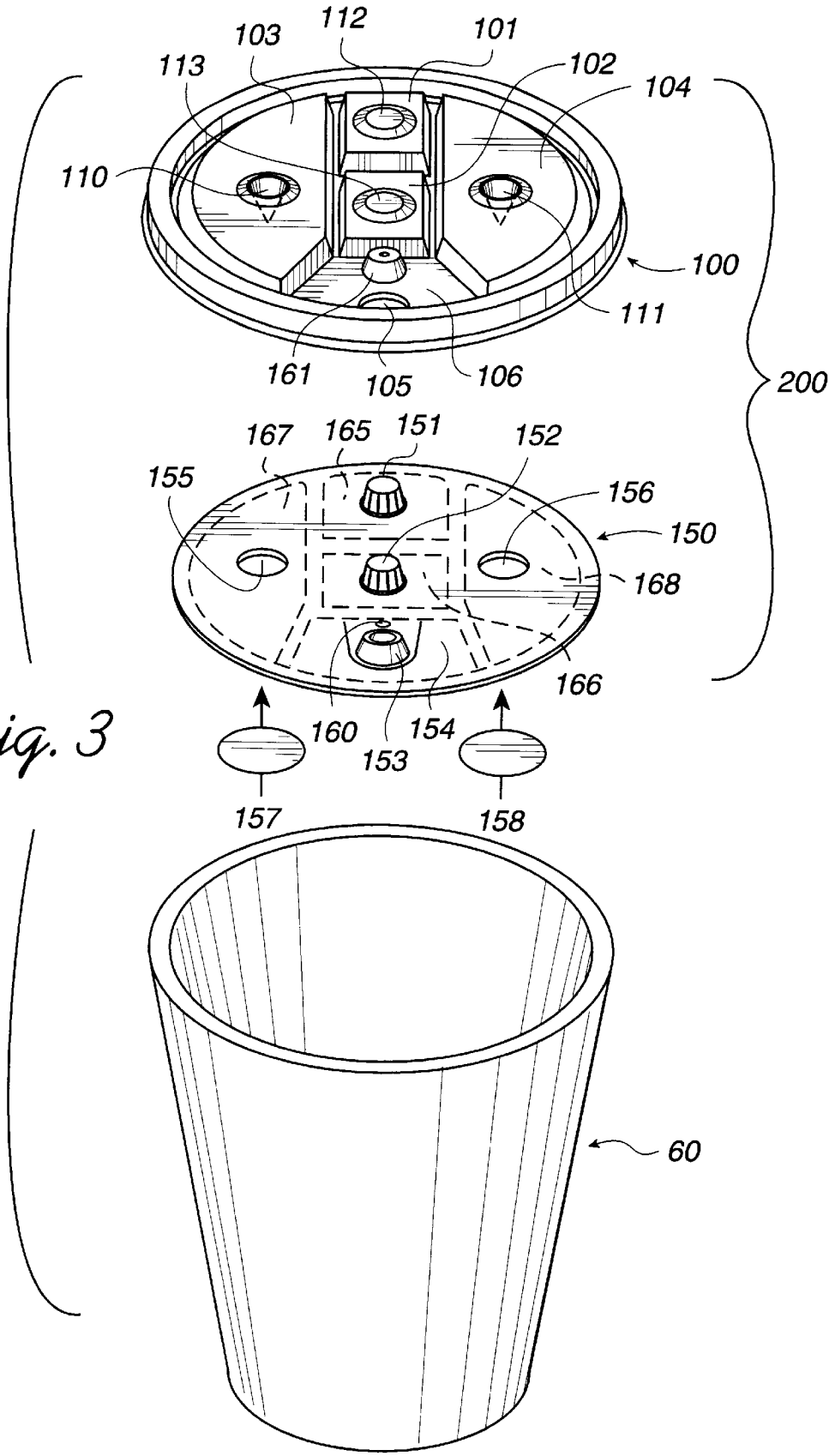
FIG. 3 illustrates the disposable lid according to a third embodiment.

FIG. 3 illustrates a third embodiment of the disposable lid 200 of the present invention. In the third embodiment, the top portion of the disposable lid 200 is being referred herein as the base member 100 to which the bottom cover 150 is attached. However, the labeling of each element is for the purpose of describing the present invention. In that regard, the element 150 may be referred to as the base member and the element 100 may be referred to as the top cover because the element 150 has many of the features of the base member 10 of the first embodiment.

According to the third embodiment, the disposable lid 200 has a base member 100 which has as a bottom cover 150 sealing the base member 100 from underneath. The base member 100 of the third embodiment differs from the base member 10 of the first embodiment as to how the cream and sugar are stored in the compartments. In the first embodiment, the additives are stored on the top of the base member 10 and the top cover 40 is placed thereon. In the third embodiment, the additives are stored underneath the base member 100 and the bottom cover 150 is placed below the base member 100 to seal the compartments.

The base member 100 has compartments 101–104 for storing powder or liquid additives. Preferably, the compartments 101 and 102 are used to store sugar and the compartments 103 and 104 are used to store cream. The base member 100 also has a 20 spout region 106 separated from other compartments 101–104 with walls defining the compartments. Each one of the compartments 101–104 is separated by the raised walls made during, for example, injection or thermal molding process. The size of each compartment can be varied depending on the amount of additives to be stored therein. Alternatively, instead of having four compartments 101–104 as shown in FIG. 3, the base member 100 may have fewer or more compartments.

Figure 5:
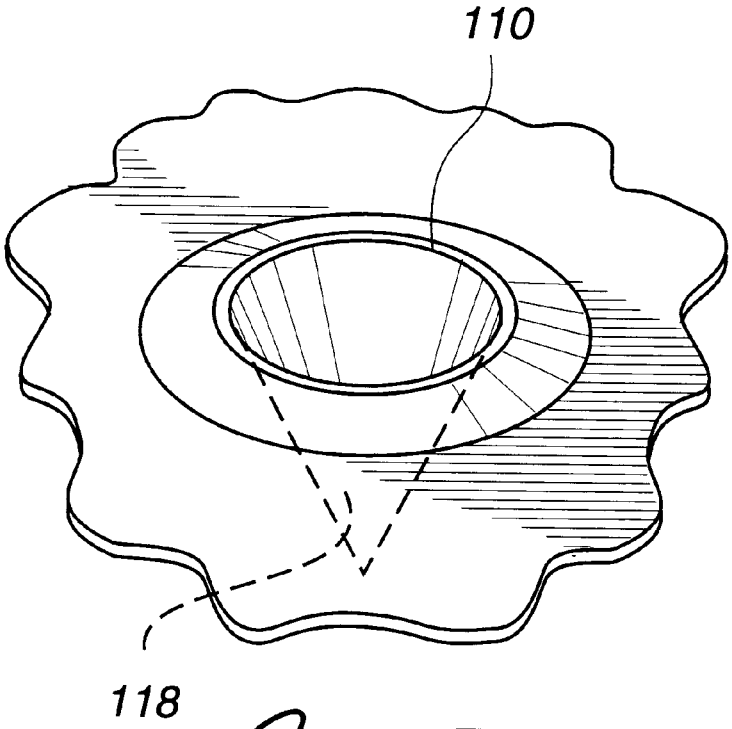
FIG. 5 illustrates a cap used for rupturing the outlet film.

The base member 100 has built-in caps 110 and 111 having an inverse cone shape projection 118 from the bottom of the base member 100. The enlarged illustration of the cap 110 is shown in FIG. 5. When the caps 110 and 111 are depressed, the inverse cone shape projections 118 puncture the film 157 and 158 sealing the holes 155 and 156. The punctured holes allow the cream in the compartments 103 and 104 to seep into the container. Alternatively, the base member 100 may have tabs 112 and 113 similar to the tabs 84 and 86 of the top cover 80 shown in FIG. 2.

The base member 100 also has a spout region 106 having an opening 105 and a vent tube 161. The vent tube 161 is constructed to align with a vent hole 160 of the bottom cover 150. The opening 105 aligns with a spout actuator 153 in the bottom cover 150.

The bottom cover 150 is made with more rigid materials, such as plastic. Preferably, the bottom cover 150 and base member 100 may be made of the same material and are either pressure or thermal sealed together. The bottom cover 150 has four compartment regions 165–168 which are aligned with the compartments 101–104.

The bottom cover 150 is attached to the base member 100 as shown by two arrows so that each compartment 101–104 is preferably air or fluid tightly sealed. More specifically, the sealable region 170 of the bottom cover 150 is affixed to the bottom surface of the dividing walls defining the compartments 101–104 of the base member 100. As a result, the bottom cover compartments 165–168 are placed substantially below the compartments 101–104 of the base member 100.

FIG. 3 shows two compartments 165 and 166 of the bottom cover 150 having corresponding protruding outlets 151–152 each one in a half-cone shape. The protruding outlets 151 and 152 are made of the same material with the rest of the bottom cover 150, and preferably are integrally manufactured with the bottom cover 150. The protruding outlets 151–152 have vertical troughs around the inner surface which can be easily torn when depressed as shown in FIG. 4. The protruding outlets 151–152 preferably have the approximately the same height as the height of the rim of the base member 100.

The bottom cover 150 also has a spout actuator 153 with a surround pre-incision or trough and a vent hole 160. When depressed, the spout actuator 153 tears around the incision 154 creating an opening for drinking. The bottom cover 150 also has a vent hole 160 which is aligned with a raised vent tube 161 of the base member 100. The raised vent 161 is beneficial since the coffee spilling out of the vent 160 is initially trapped in the raised vent 161 to avoid splashing the drinker's face. The construction of the spout actuator 153 and the went hole 160 are similar to the corresponding elements in the base member 20 shown in FIG. 1, and thus will not be repeated here.

Each protruding outlet 151 and 152 can be depressed with the assistance of the corresponding depressible tabs 112 and 113 of the base member 100. The depression of the protruding outlets 151 and 152 in the bottom cover 150 through the corresponding tabs 112 and 113 of the base member 100 causes the protruding outlets 151–152 to be vertically contracted which in turn causes the troughs to break and thus allows the additives, either in liquid or powdered form, to flow into the container 60.

The holes 155 and 156 in the corresponding compartments 167 and 168 of the bottom cover 150 are covered with films or thin plastic membranes 157 and 158 which can be easily torn with a sharp abject. The thin plastic membranes 157 and 158 are preferably made with cellophane like material or any suitable material that can easily be punctured. The diameter of the membranes 157 and 158 are slightly larger than that of the openings 155 and 156 and are air or fluid tightly affixed to corresponding openings 155 and 156.

Each cap 110 and 111 in the base member 100 can be individually depressed with a finger. The depression of the caps 110 and 111 causes the inverse cone shape projection on the bottom of the base member 100 to puncture or rip the thin plastic membrane sealing the bottom cover 150. The punctured plastic membrane allows the additives, either in liquid or powdered form, to flow into the container 60.

Although the third embodiment of the disposable lid 200 shown in FIG. 3 has two caps 110 and 111, two tabs 112 and 113 and corresponding openings 155 and 156 and protruding outlets 151 and 152, all of the compartments 101–104 of the base member 100 may be equipped with caps with corresponding membranes similar to 157 and 158. Alternatively, all of the compartments 101–104 of the base member 100 may be equipped with tabs with corresponding protruding outlets similar to 151 and 152.

Figure 6:
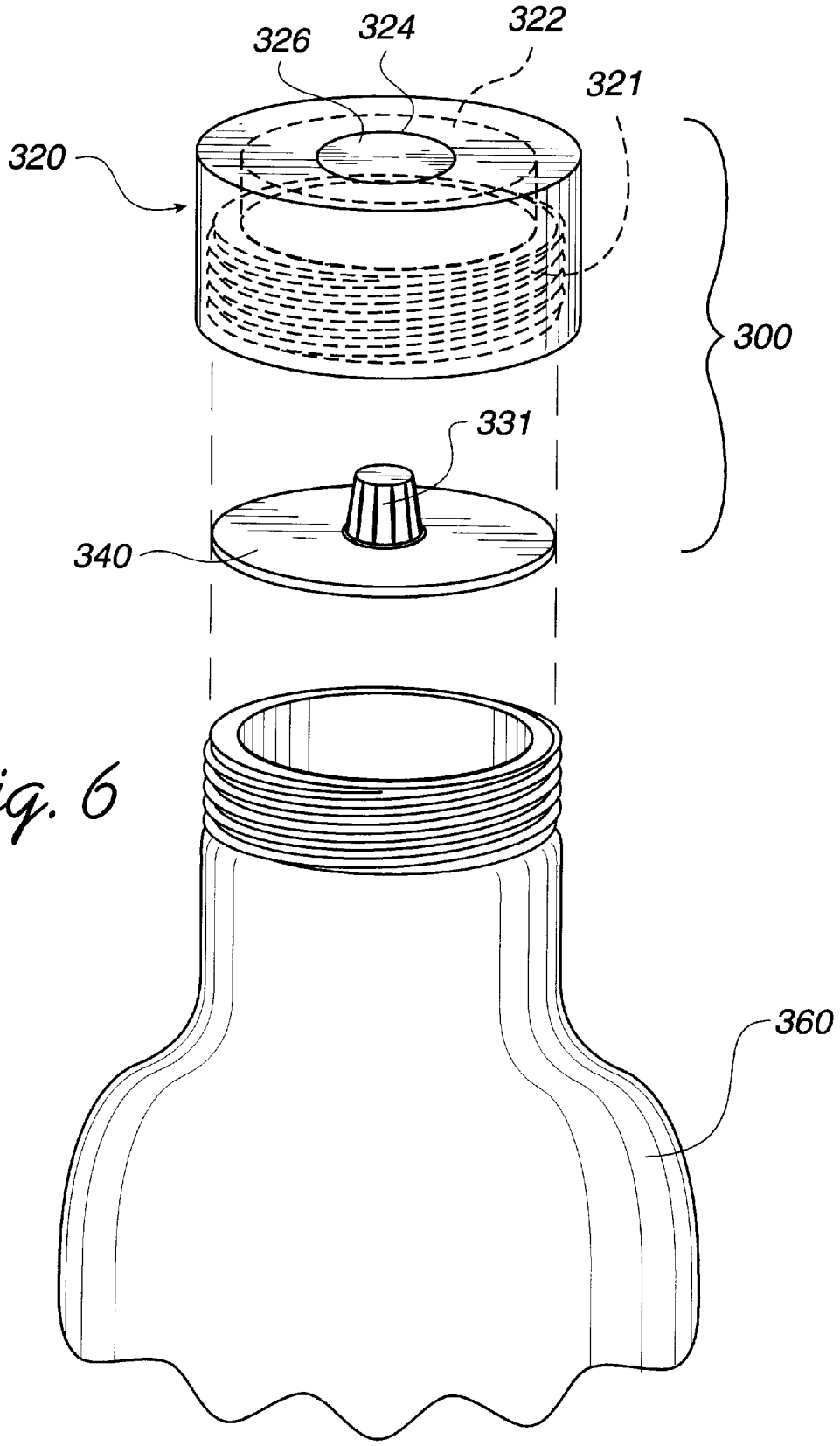
FIG. 6 illustrates the disposable lid according to a fourth embodiment of the present invention.

FIG. 6 illustrates a disposable lid 300 according to the fourth embodiment of the present invention. The concept and the function of the disposable lid 300 is similar to that of first and second embodiments. The disposable lid 300 includes a disc shaped base cap 320 and a similarly shaped bottom cover 340 for mounting inside the base cap 320. The base cap 320 is used for sealing any type of container, such as a bottle 360, containing beverage or other liquid. The bottom cover 340 is affixed to the inner circular fringe 321 of the base cap 320.

The base cap 320 has a compartment 322 for storing an additive in powder or liquid form, such as sugar or other substance. The size of the compartment 322 can be varied depending on the amount of substance to be stored therein.

The bottom cover 340 has a protruding outlet 331 comprising a half-cone shape. The enlarged illustration of the protruding outlet 331 is identical to the corresponding element of the first embodiment and is shown in FIG. 4. Consequently, the detailed description of the protruding outlet 331 will not be repeated.

The base cap 320 has a preferably circular depression region 324 air or fluid tightly sealed with a top cover 326 made with a flexible material, such as film, vinyl, etc. The depression region 324 is arranged immediately above the protruding outlet 331.

After an additive, such as sugar, is placed in the compartment 322, the neck 321 of the base cap 320 is air or fluid tightly covered with the bottom cover 340. The bottom cover 340 is preferably made with a rigid material, such as plastic. Preferably, the bottom cover 340 and base cap 310 may be either pressure or thermal sealed together. Because the top cover 326 is made with a flexible material, the top cover can be depressed without disturbing the integrity of the seal created by the base cap 320 and the top cover 326. The depression of the protruding outlet 331 in the bottom cover 340 through the top cover 326 causes the protruding outlet 331 to be vertically contracted, which in turn causes the troughs 39 to break and thus allows the substance stored in the compartment 322 to flow into the bottle 360.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A lid for use with a container and having a pre-stored additive, the lid comprising:

a base member sized to fit over the container, the base member having at least one compartment region which has a sealed outlet, wherein the outlet is erected from the base member and has a plurality of troughs in the outlet formed substantially perpendicularly with respect to the base member; and a cover sealing the compartment region to prevent the additive from exiting the compartment region, wherein when the cover is actuated against the outlet, the troughs in the outlet breaks open and allows the additive in the compartment region to flow into the container.

2. A lid of claim 1, wherein the cover is made of a flexible material to permit the outlet to be depressed by applying pressure on the cover.

3. A lid of claim 1, the cover further comprising a tab protruding from the cover and forming an integral part of the cover, wherein the tab is substantially aligned with the outlet to permit the outlet to be depressed by applying pressure on the tab.

4. A lid of claim 3, wherein the cover is made of a rigid material.

5. A lid of claim 1, the base member has a spout actuator which creates an aperture when depressed to drink the content from the container.

6. A lid of claim 5, wherein the cover has a spout region which substantially surrounds the spout actuator.

7. A lid of claim 1, wherein the compartment region of the base member is formed by raised walls surrounding the compartment region, the cover being affixed to top of the raised wall to create an air tight seal.

8. A lid of claim 7, wherein the base member has a spout actuator which creates an aperture when depressed to drink the content from the container.

9. A lid of claim 1, wherein the cover has a lowered walls surrounding the compartment region of the base member, the base member being affixed to the bottom of the bottom of the lowered walls to create an air tight seal.

10. A lid of claim 9, the cover further comprising an actuating region having a downward projection and the outlet of the base member being an aperture substantially aligned with the actuating region and sealed with a sealing layer, wherein the sealing layer breaks open from the aperture when the actuating region is depressed.

11. A lid of claim 10, wherein the sealing layer is made of a thin plastic which is easily rupturable.

12. A lid of claim 9, the cover further comprising an actuating region and the outlet projects from the base member and has troughs formed in the outlet, the outlet being substantially aligned with the actuating region, wherein the outlet opens at the troughs to allow the additive to exit out of the compartment region when the actuating region is depressed.

13. A lid of claim 12, wherein the actuating region comprising a tab protruding from the cover and forming an integral part of the cover, wherein the tab is substantially aligned with the outlet to permit the outlet to be depressed by applying pressure on the tab.

14. A lid of claim 13, wherein the cover is made of a rigid material.

15. A lid of claim 1, wherein the base member has first and second compartment regions, in which the first compartment region is for a first substance and the second compartment region is for a second substance.

16. A method for making a lid for use with a container and having a pre-stored additive, the method comprising the steps of:

preparing a base member sized to fit over the container, the base member having at least one compartment region which has a sealed outlet, wherein the outlet is erected from the base member and has a plurality of troughs in the outlet formed substantially perpendicularly with respect to the base member; and preparing a cover sealing the compartment region to prevent the additive from exiting the compartment region, wherein when the cover is actuated against the outlet, the troughs in the outlet breaks open and allows the additive in the compartment region to flow into the container.

17. A method of claim 16, wherein the cover is made of a flexible material to permit the outlet to be depressed by applying pressure on the cover.

18. A lid of claim 16, the cover further comprising a tab protruding from the cover and forming an integral part of the cover, wherein the tab is substantially aligned with the outlet to permit the outlet to be depressed by applying pressure on the tab.

19. A method of claim 16, further comprising the steps of:

placing the pre-stored additive in the compartment region; and sealing the cover over the compartment region of the base member.

* * * * *